US009346636B2

(12) United States Patent
Akagawa

(10) Patent No.: US 9,346,636 B2
(45) Date of Patent: May 24, 2016

(54) PROCESSING APPARATUS AND IMAGE FORMING APPARATUS

(71) Applicant: Sharp Kabushiki Kaisha, Osaka-shi, Osaka (JP)

(72) Inventor: Yuhi Akagawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/648,767

(22) PCT Filed: Nov. 27, 2013

(86) PCT No.: PCT/JP2013/081850

§ 371 (c)(1),
(2) Date: Jun. 1, 2015

(87) PCT Pub. No.: WO2014/087891

PCT Pub. Date: Jun. 12, 2014

(65) Prior Publication Data

US 2015/0298923 A1 Oct. 22, 2015

(30) Foreign Application Priority Data

Dec. 4, 2012 (JP) ..... 2012-264920
Nov. 11, 2013 (JP) ..... 2013-232694

(51) Int. Cl.
*B65H 3/44* (2006.01)
*B65H 31/24* (2006.01)
(Continued)

(52) U.S. Cl.
CPC ..... *B65H 1/266* (2013.01); *B65H 1/00* (2013.01); *B65H 1/04* (2013.01); *B65H 3/44* (2013.01); *B65H 31/22* (2013.01); *B65H 31/24* (2013.01); *G03G 15/6502* (2013.01); *G03G 21/1647* (2013.01);
(Continued)

(58) Field of Classification Search
CPC ..... B65H 3/44; B65H 1/04; B65H 1/266; B65H 2402/441; B65H 2407/21; B65H 31/22; B65H 31/24; G03G 15/6502; G03G 15/6514
See application file for complete search history.

(56) References Cited

U.S. PATENT DOCUMENTS 6,314,267 B1 11/2001 Kida
6,876,830 B2 * 4/2005 Ohgita ..... G03G 15/70 399/107
6,882,823 B2 * 4/2005 Matsuyama ..... G03G 15/6538 399/110
7,233,754 B2 * 6/2007 Kida ..... G03G 15/6502 399/124
7,431,287 B2 * 10/2008 Hayashi ..... B65H 1/26 271/162
(Continued)

FOREIGN PATENT DOCUMENTS

JP 2002-308520 A 10/2002
JP 2003-285963 A 10/2003
(Continued)

*Primary Examiner* — Luis A Gonzalez
(74) *Attorney, Agent, or Firm* — Keating & Bennett, LLP

(57) ABSTRACT

An image forming apparatus includes a main body and a processing apparatus. The processing apparatus includes a first processing unit and a second processing unit. The main body has a manual-feed tray at one lateral face. The first processing unit and the second processing unit are stacked in the vertical direction on the same lateral face side of the main body as the manual-feed tray provided. The second processing unit is slidable in a toward-away direction between a connecting position and a separate position, and has a hollow to insert the manual-feed tray therein at the connecting position.

18 Claims, 11 Drawing Sheets

(51) Int. Cl.

| | |
|---|---|
| ***B65H 31/22*** | (2006.01) |
| ***B65H 1/04*** | (2006.01) |
| ***G03G 15/00*** | (2006.01) |
| ***B65H 1/26*** | (2006.01) |
| ***G03G 21/16*** | (2006.01) |
| ***B65H 1/00*** | (2006.01) |

(52) U.S. Cl.

CPC ..... *B65H 2402/31* (2013.01); *B65H 2402/32* (2013.01); *B65H 2402/40* (2013.01); *B65H 2402/411* (2013.01); *B65H 2405/31* (2013.01); *B65H 2405/312* (2013.01); *B65H 2405/324* (2013.01); *B65H 2407/21* (2013.01);*B65H 2801/06* (2013.01); *G03G 2221/1654* (2013.01); *G03G 2221/1684* (2013.01)

(56) References Cited

U.S. PATENT DOCUMENTS

| | | | |
|---|---|---|---|
| 2006/0023005 | A1 | 2/2006 | Katsuyama et al. |
| 2009/0074494 | A1 | 3/2009 | Katsuyama et al. |
| 2011/0298873 | A1 | 12/2011 | Katsuyama et al. |
| 2015/0123339 | A1 | 5/2015 | Akagawa |

FOREIGN PATENT DOCUMENTS

| | | | |
|---|---|---|---|
| JP | 2004-230880 | A | 8/2004 |
| JP | 2014-006365 | A | 1/2014 |

* cited by examiner

PROCESSING APPARATUS AND IMAGE FORMING APPARATUS

TECHNICAL FIELD

The present invention relates to a processing apparatus including a first processing unit and a second processing unit, the processing apparatus being disposed on a lateral face side of a main apparatus to perform image forming processing to a sheet, and relates to an image forming apparatus including the same.

BACKGROUND ART

Conventionally some image forming apparatuses include a processing apparatus made up of a plurality of processing units for extended features, in addition to a main body (main apparatus) of the apparatus to perform image forming processing to a sheet. Exemplary processing units include a high-capacity sheet feeding apparatus to store sheets therein and feed a sheet to the main body of the apparatus, and a post-processing apparatus to perform post-processing to a sheet subjected to image forming processing by the main body of the apparatus. If a first processing unit and a second processing unit are disposed on mutually opposed lateral faces of the main body of the apparatus, then the footprint of the image forming apparatus will be increased.

Then, an image forming apparatus is known, including a sheet-output tray (hereinafter this may be simply called an output tray) on a sheet-feeding tray (hereinafter this may be simply called a feeding tray) (see Patent Literature 1, for example). This conventional image forming apparatus includes the feeding tray and the output tray that are vertically stacked, whereby the footprint of the apparatus can be decreased as compared with the case where the feeding tray and the output tray are disposed on different lateral faces of the main body of the apparatus.

CITATION LIST

Patent Literature

Patent Literature 1: Japanese Patent Application Laid-Open No. 2004-230880

SUMMARY OF INVENTION

Technical Problem

In the conventional image forming apparatus, however, the output tray located above cannot slide to move toward and away from the main body of the apparatus. If a sheet fed or output is not conveyed successfully at a connecting part with the main body of the apparatus, it is difficult to perform maintenance, such as removing of the sheet.

In the conventional image forming apparatus, lightweight and simple-structured members, such as the feeding tray and the output tray, are stacked vertically on the same lateral face of the main body of the apparatus, which are not a processing unit. The conventional image forming apparatus is configured so that the output tray is bendable to be lifted upward, which is the configuration that can be achieved because the output tray is lightweight. A similar configuration cannot be applied to a processing unit that is relatively large in mass. In this way, in the case of a conventional image forming apparatus including a first processing unit and a second processing unit, it is difficult to perform maintenance of the processing units.

If the conventional image forming apparatus is further provided with a processing unit that is slidable to move toward and away from the main body of the apparatus on the same lateral face as the sheet trays, in addition to the sheet trays provided at the main body of the apparatus, the footprint of the apparatus as a whole will be increased because it requires the footprint of the processing unit also in addition to the footprint for the main body of the apparatus and the sheet trays.

Then the present invention aims to provide a processing apparatus capable of decreasing the footprint of the apparatus, and facilitating maintenance of a processing unit provided on a lateral face of a main apparatus, and to provide an image forming apparatus including the same.

Solution to Problem

A processing apparatus of the present invention includes a first processing unit and a second processing unit. The first processing unit and the second processing unit are stacked vertically on a lateral face of a main apparatus to perform image forming processing to a sheet, the main apparatus being provided with a sheet tray having a base end part supported at the lateral face. The second processing unit is disposed on the first processing unit, the second processing unit being slidable between a connecting position of connecting to the main apparatus and a predetermined separate position away from the main apparatus in a toward-away direction to move toward or away from the main apparatus, the second processing unit having a space part, in which at least part of the sheet tray can be displaced when the second processing unit is at the connecting position. The space part has openings at a lateral face of the second processing unit that is on a side of the main apparatus facing the main apparatus and at least one lateral face other than the lateral face on the side of the main apparatus.

With this configuration, since the first processing unit and the second processing unit are vertically stacked on the same lateral face side of the main apparatus, the footprint of the apparatus can be decreased as compared with the case where the processing units are disposed on mutually different lateral faces of the main apparatus. Further the second processing unit is slidable in the toward-away direction of the main apparatus, and so the connecting part between the second processing unit and the main apparatus can be open, whereby workability to this connecting part can be improved. That is, even when a failure in conveyance of a sheet occurs between the second processing unit and the main apparatus, maintenance such as removing of the sheet can be easily performed. Moreover, the second processing unit located above is slid to expose a part of the top face of the first processing unit, whereby the workability to the first processing unit from the above can be improved. This can facilitate the maintenance of the first processing unit as well.

Since the first processing unit, the second processing unit and the sheet tray are disposed collectively on the same lateral face side of the main apparatus, the working efficiency can be improved during maintenance of two or more of the first processing unit, the second processing unit and the sheet tray.

Since at least a part of the sheet tray is displaced in the space part when the second processing unit is at the connecting position, the footprint of the sheet tray and the footprint of the second processing unit overlap one another at least partially. This can decrease the footprint of the processing apparatus as a whole.

When the second processing unit is disposed at the connecting position as well, a sheet can be supplied or be taken out from the sheet tray through the opening that is provided at the face of the second processing unit other than the lateral face on the main apparatus side, and so the workability to the sheet tray is good. When the second processing unit is moved to the separate position, maintenance for the sheet tray can be easily performed.

An image forming apparatus of the present invention includes: a main body, a first processing unit and a second processing unit. The main body performs image forming processing to a sheet. The main body is provided with a sheet tray having a base end part supported at a lateral face of the main body. The first processing unit and the second processing unit are stacked vertically on the lateral face of the main body. The second processing unit is disposed on the first processing unit, the second processing unit being slidable between a connecting position of connecting to the main body and a predetermined separate position away from the main body in a toward-away direction to move toward or away from the main body, the second processing unit having a space part, in which at least part of the sheet tray can be displaced when the second processing unit is at the connecting position. The space part has openings at a lateral face of the second processing unit that is on a side of the main body facing the main body and at at least one lateral face other than the lateral face on the side of the main body.

With this configuration, since the first processing unit and the second processing unit are vertically stacked on the same lateral face side of the main body, the footprint of the apparatus can be decreased as compared with the case where the processing units are disposed on mutually different lateral faces of the main body. Further the second processing unit is slidable in the toward-away direction of the main body, and so the connecting part between the second processing unit and the main body can be open, whereby workability to this connecting part can be improved. That is, even when a failure in conveyance of a sheet occurs between the second processing unit and the main body, maintenance such as removing of the sheet can be easily performed. Moreover, the second processing unit located above is slid to expose a part of the top face of the first processing unit, whereby the workability to the first processing unit from the above can be improved. This can facilitate the maintenance of the first processing unit as well.

Since the first processing unit, the second processing unit and the sheet tray are disposed collectively on the same lateral face side of the main body, the working efficiency can be improved during maintenance of two or more of the first processing unit, the second processing unit and the sheet tray.

Since at least a part of the sheet tray is displaced in the space part when the second processing unit is at the connecting position, the footprint of the sheet tray and the footprint of the second processing unit overlap one another at least partially. This can decrease the footprint of the image forming apparatus as a whole.

When the second processing unit is disposed at the connecting position as well, a sheet can be supplied or be taken out from the sheet tray through the opening that is provided at the face of the second processing unit other than the lateral face on the main body side, and so the workability to the sheet tray is good. When the second processing unit is moved to the separate position, maintenance for the sheet tray can be easily performed.

Advantageous Effects of Invention

According to the present invention, the footprint of the apparatus can be decreased, and maintenance of a first processing unit and a second processing unit provided on a lateral face of a main apparatus can be easily performed.

DESCRIPTION OF EMBODIMENTS

Figure 1:
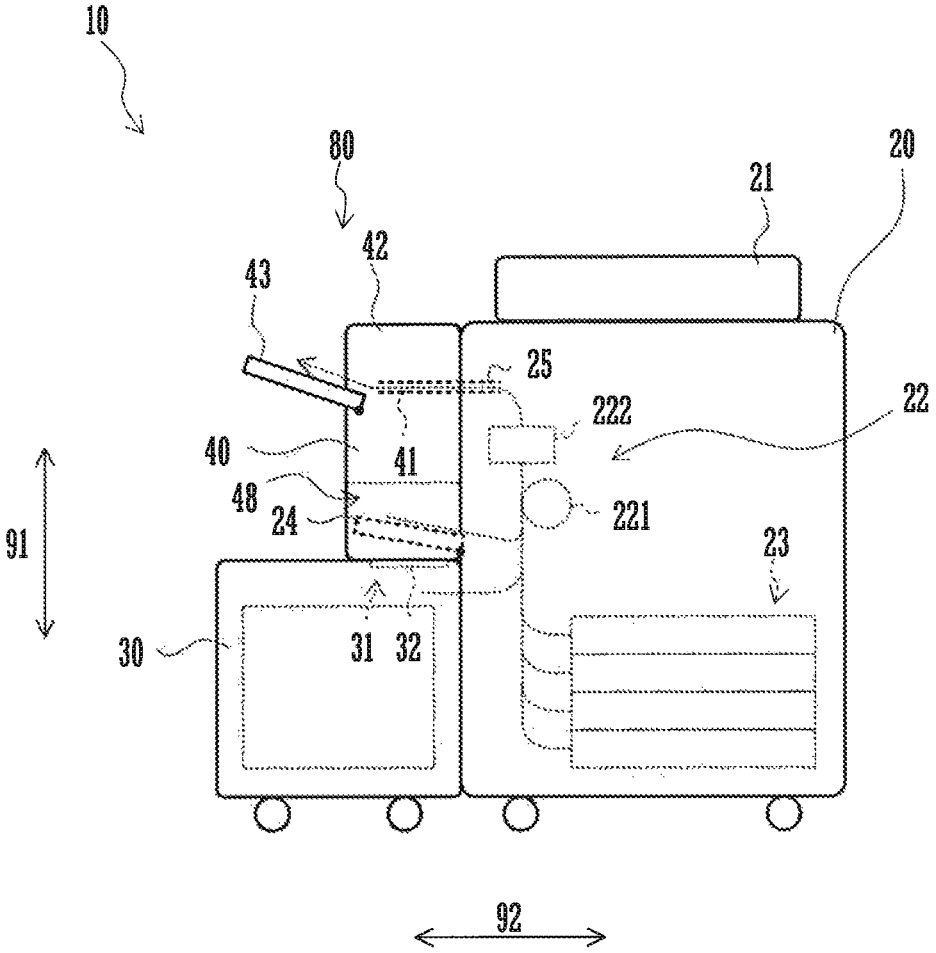
FIG. 1 is a front view illustrative of the schematic configuration of an image forming apparatus according to Embodiment 1 of the present invention.
Figure 2:
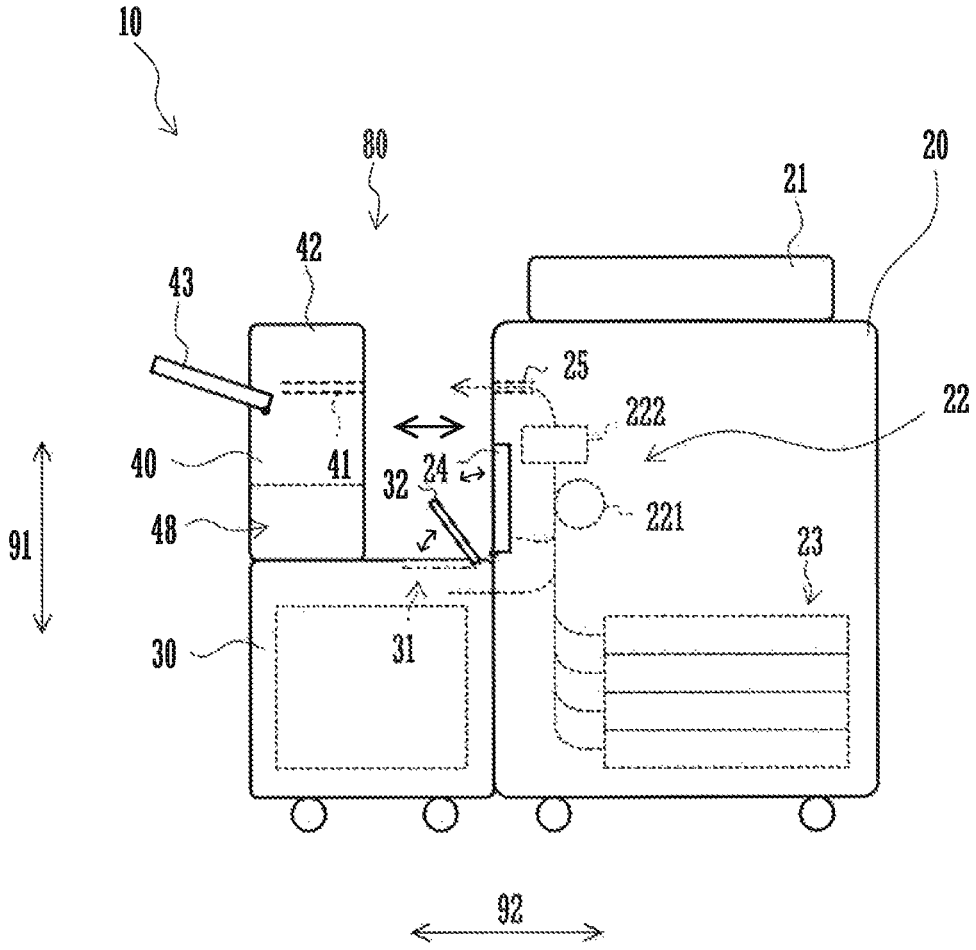
FIG. 2 is a schematic front view illustrative of the image forming apparatus where a second processing unit is disposed at a separate position.
Figure 3:
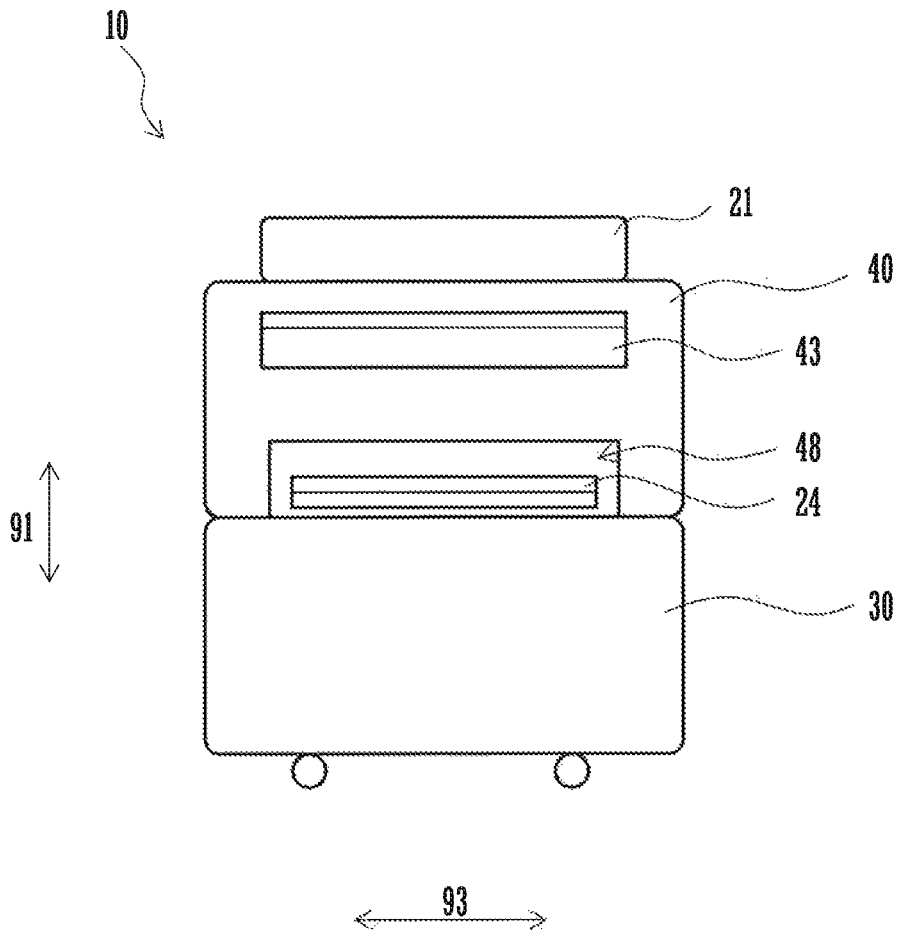
FIG. 3 is a schematic left lateral view of the image forming apparatus.

As illustrated in FIGS. 1 to 3, an image forming apparatus 10 according to Embodiment 1 of the present invention includes a main body 20 of the apparatus and a processing apparatus 80. The processing apparatus 80 includes a first processing unit 30 and a second processing unit 40. The main body 20 is a main apparatus relative to the processing apparatus 80. The image forming apparatus 10 in Embodiment 1 is an electrophotographic-type copying machine.

The main body 20 includes an Auto Document Feeder (ADF) 21, an image forming section 22, a sheet-feeding cassette 23, a manual-feed tray 24, and an image reading section not illustrated.

The ADF 21 conveys a document one by one so as to pass through a predetermined image reading position. The image reading section creates image data by reading an image on a document conveyed through the image reading position.

The sheet-feeding cassette 23 stores sheets of a size that is frequently used. The manual-feed tray 24 has abase end supported at one of lateral faces of the main body 20. The manual-feed tray 24 is rotatable around the based end as the supporting point between a protruding position that protrudes horizontally as in FIG. 1 and the storage position along the lateral face of the main body 20 above the base end as in FIG. 2. The manual-feed tray 24 is disposed at the protruding position when the main body 20 is in the operating state, and is disposed at the storage position during maintenance.

The manual-feed tray 24 is to place a sheet of a size that is relatively less-frequently used. The manual-feed tray 24 is one example of the sheet tray. A sheet is supplied to the image forming section 22 from selected one of the sheet-feeding cassette 23 and the manual-feed tray 24.

The image forming section 22 includes a photoreceptor drum 221 and a fixing unit 222, and executes image forming processing to form an image on a sheet in accordance with image data. The image forming section 22 is not limited to electrophotographic type, which may be of an ink jet type, for example.

The first processing unit 30 and the second processing unit 40 are disposed on the same lateral face side of the main body 20 to be stacked in the vertical direction 91. This can reduce the footprint of the apparatus as compared with the case where these units are disposed on mutually different lateral faces of the main body 20. The first processing unit 30 and the second processing unit 40 are disposed on the same lateral face side as the manual-feed tray 24.

The first processing unit 30, the second processing unit 40 and the manual-feed tray 24 are disposed collectively on the same lateral face side of the main body 20, and so the working efficiency can be improved during maintenance of two or more of the first processing unit 30, the second processing unit 40 and the manual-feed tray 24.

The first processing unit 30 is fixedly joined to the main body 20 with a screw or the like not illustrated. In one example, the first processing unit 30 is a high-capacity sheet-feeding unit to store sheets therein and feed a sheet to the image forming section 22. The sheet conveyance path of the first processing unit 30 and the sheet conveyance path for reception of the image forming section 22 are formed continuously. The first processing unit 30 feeds a sheet one by one to the image forming section 22 as needed. Since the sheet-feeding unit is provided apart from the main body 20, a large quantity of sheets can be stored in the sheet-feeding unit, whereby image forming processing can be performed continuously on a large quantity of sheets that are supplied at one time.

The second processing unit 40 is disposed on the first processing unit 30. The second processing unit 40 is slidable in a toward-away direction 92 to move toward or away from the main body 20 between the connecting position where it is connected to the main body 20 as in FIG. 1, and a predetermined separate position where it is away from the main body 20 as in FIG. 2. The second processing unit 40 is disposed at the connecting position when the main body 20 is in the operating state.

Figure 7A:
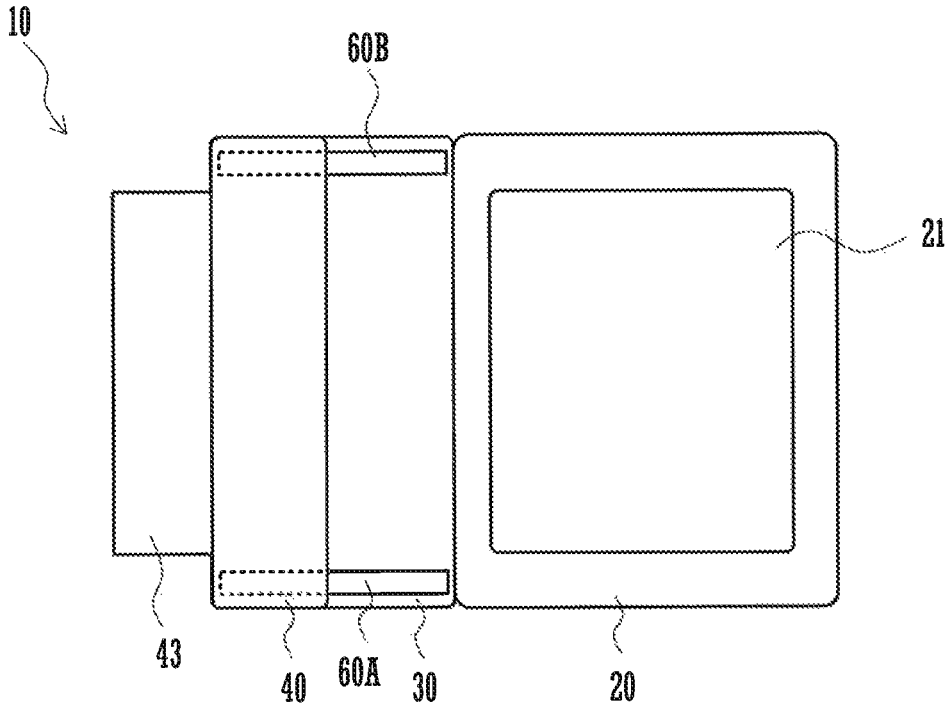
FIG. 7A is a plan view illustrative of the configuration where the second processing unit is supported at the top face of the first processing unit, and is slidable in the toward-away direction.
Figure 7B:
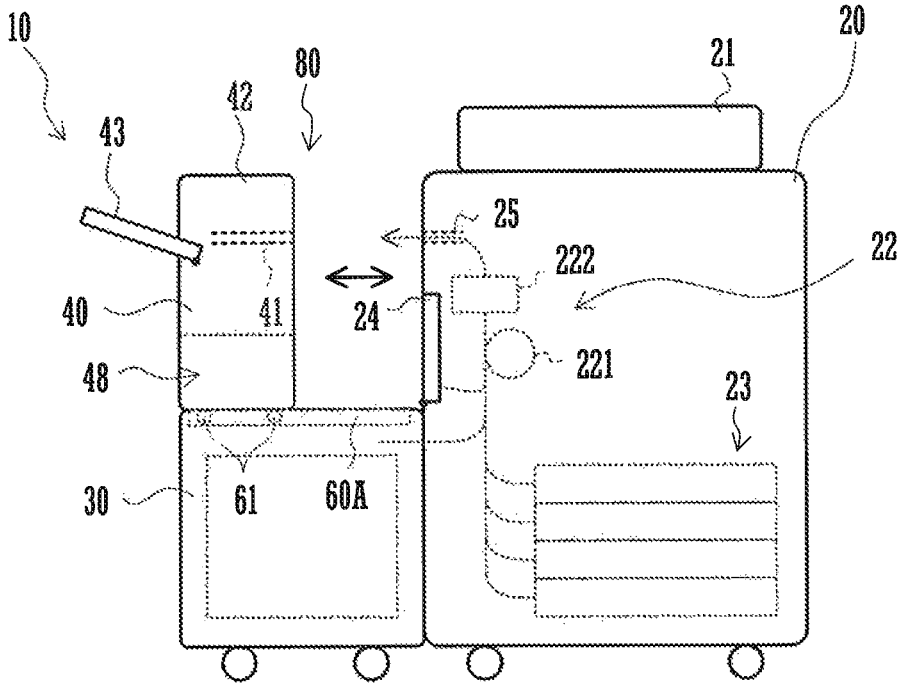
FIG. 7B is a front view thereof.

Specifically as illustrated in FIG. 7A and FIG. 7B, the second processing unit 40 is configured to be slidable in the toward-away direction 92 while being supported at the top face of the first processing unit 30. On the top face of the first processing unit 30, rail members 60A and 60B are provided so as to be extended in the toward-away direction 92, and the second processing unit 40 has rollers 61 at the bottom face so that the rollers 61 travel along the rail members 60A and 60B, whereby the second processing unit 40 slides to move in the toward-away direction 92 while being supported at the top face of the first processing unit 30. Since the second processing unit 40 slides while being supported at the top face of the first processing unit 30, unintended inclination of the second processing unit 40 in the toward-away direction 92 or in a depth direction 93 orthogonal to the toward-away direction 92 and the vertical direction 91 can be prevented.

The second processing unit 40 has a hollow 48, into which at least apart of the manual-feed tray 24 at the protruding position is to be inserted at the connecting position. The hollow 48 has openings at the lateral face on the main body side (main-apparatus side lateral face) facing the main body 20 and at least one face other than the lateral face on the main body side of the lateral faces of the second processing unit 40. In Embodiment 1, the hollow 48 penetrates through the toward-away direction 92. The hollow 48 has a space where a sheet can be loaded between the manual-feed tray 24 and the ceiling face of the hollow 48 when the second processing unit 40 is disposed at the connecting position.

Since the manual-feed tray 24 is inserted into the hollow 48 when the second processing unit 40 is at the connecting position, the footprint of the manual-feed tray 24 and the footprint of the second processing unit 40 overlap one another at least partially. This can decrease the footprint of the image forming apparatus 10 as a whole. Further, since the hollow 48 penetrates through in the toward-away direction 92, operations to the second processing unit 40, such as supplying of sheets to the manual-feed tray 24 from the opposite side of the main body 20 can be performed even when the second processing unit 40 is at the connecting position.

In one example, the second processing unit 40 is a post-processing apparatus to perform post-processing to a sheet subjected to image forming processing at the image forming section 22. At the connecting position, a sheet conveyance path 41 for reception of the second processing unit 40 is continuous to a sheet conveyance path 25 for output of the image forming section 22, whereby a sheet subjected to image forming processing can be conveyed to the second processing unit 40 smoothly. Exemplary post-processing includes stapling, punching, Z folding, face-up outputting, face-down outputting and sorting. Post-processing performed to a sheet subjected to image forming processing can improve the efficiency of paper work.

Figure 8:
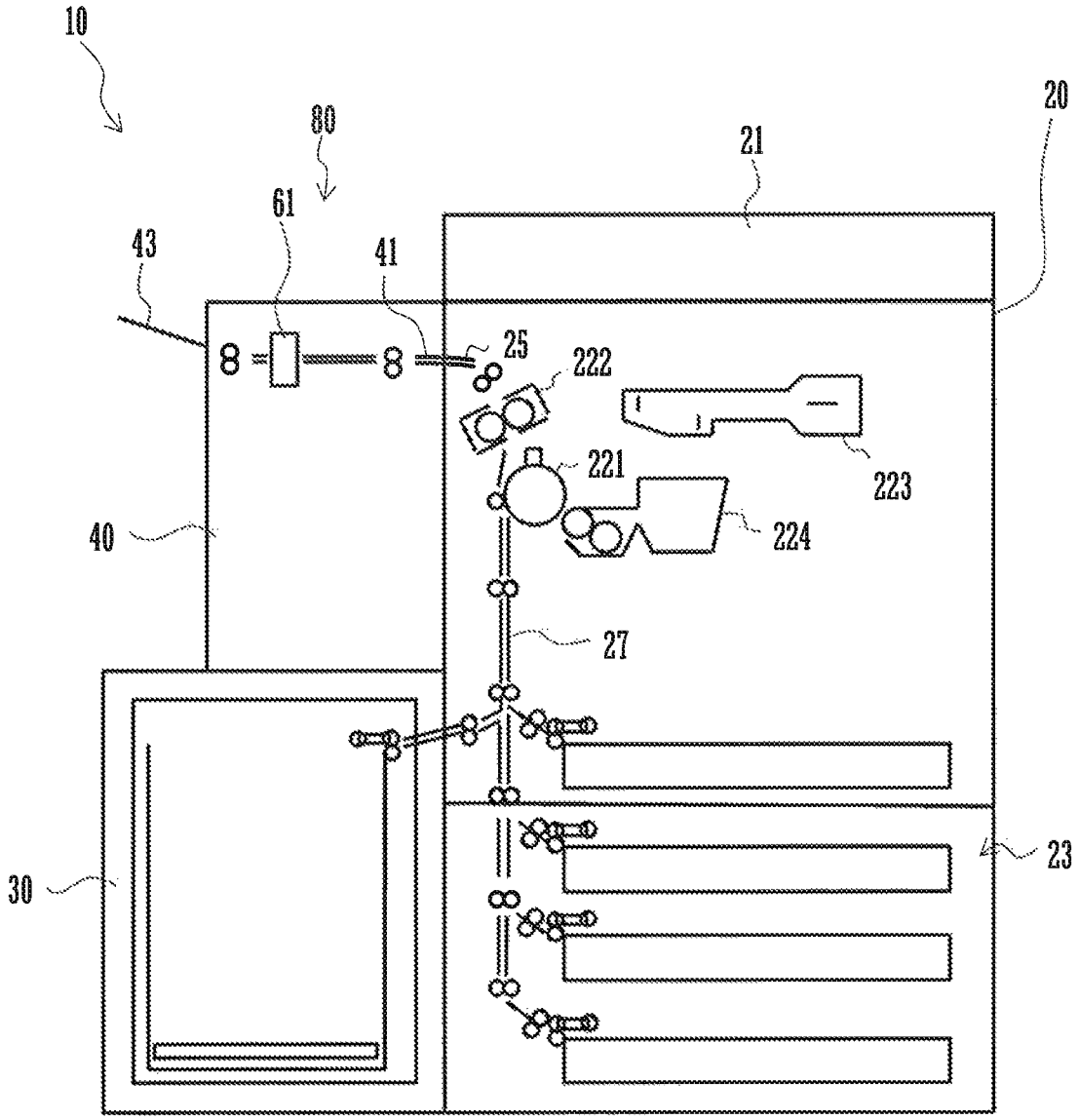
FIG. 8 is schematic cross-sectional view of the image forming apparatus to describe a specific example of a sheet conveyance path.

Referring to FIG. 8, the following describes a specific example of the sheet conveyance path when the image forming apparatus 10 is of an electrophotographic type. As a sheet supplied from the sheet-feeding cassette 23 travels through a sheet conveyance path 27, a toner image is formed by the photoreceptor drum 221, an exposure unit 223, a developing unit 224 and the like on the sheet, and the toner image is fixed to the sheet by the fixing unit 222. Then, the sheet passes through the sheet conveyance path 25 and the sheet conveyance path 41 to be conveyed to the second processing unit 40, where punching is performed to the sheet by a punching unit 61 for outputting to an output tray 43. The configuration of the sheet conveyance path is not limited to this.

As illustrated in FIG. 2, when the second processing unit 40 is disposed at the separate position, then the connecting part between the second processing unit 40 and the main body 20 can be open, meaning that the workability to this connecting part can be improved. That is, even when a problem occurs, such as a failure in conveyance of a sheet, between the second processing unit 40 and the main body 20, maintenance such as removing of the sheet can be easily performed.

The second processing unit 40 disposed at the separate position facilitates the maintenance of the manual-feed tray 24.

The second processing unit 40 disposed at the separate position allows the manual-feed tray 24 to be rotated from the protruding position to the storage position.

The first processing unit 30 has an opening 31 of a size, through which a member relating to image forming processing is loaded or unloaded. In this embodiment, a sheet is supplied to the first processing unit 30 through the opening 31. In the state where the second processing unit 40 is disposed at the separate position and the manual-feed tray 24 is disposed at the storage position, then the opening 31 is exposed to the outside. In this embodiment, the first processing unit 30 is provided with a lid member 32 that can open and close the opening 31. When the second processing unit 40 is disposed at the separate position and the manual-feed tray 24 is disposed at the storage position, then the lid member 32 is exposed to the outside, and when the lid member 32 is opened, the opening 31 is open.

In this way, when the second processing unit 40 is disposed at the separate position and the manual-feed tray 24 is disposed at the storage position, a part of the top face of the first processing unit 30 is exposed, so that the workability to the first processing unit 30 from the above can be improved. Specifically, the second processing unit 40 is disposed at the separate position and the manual-feed tray 24 is disposed at the storage position, and then the opening 31 is open by opening the lid member 32, whereby workability to the inside of the first processing unit 30 through the opening 31 can be improved. This can facilitate the maintenance of the first processing unit 30 as well.

Figure 4:
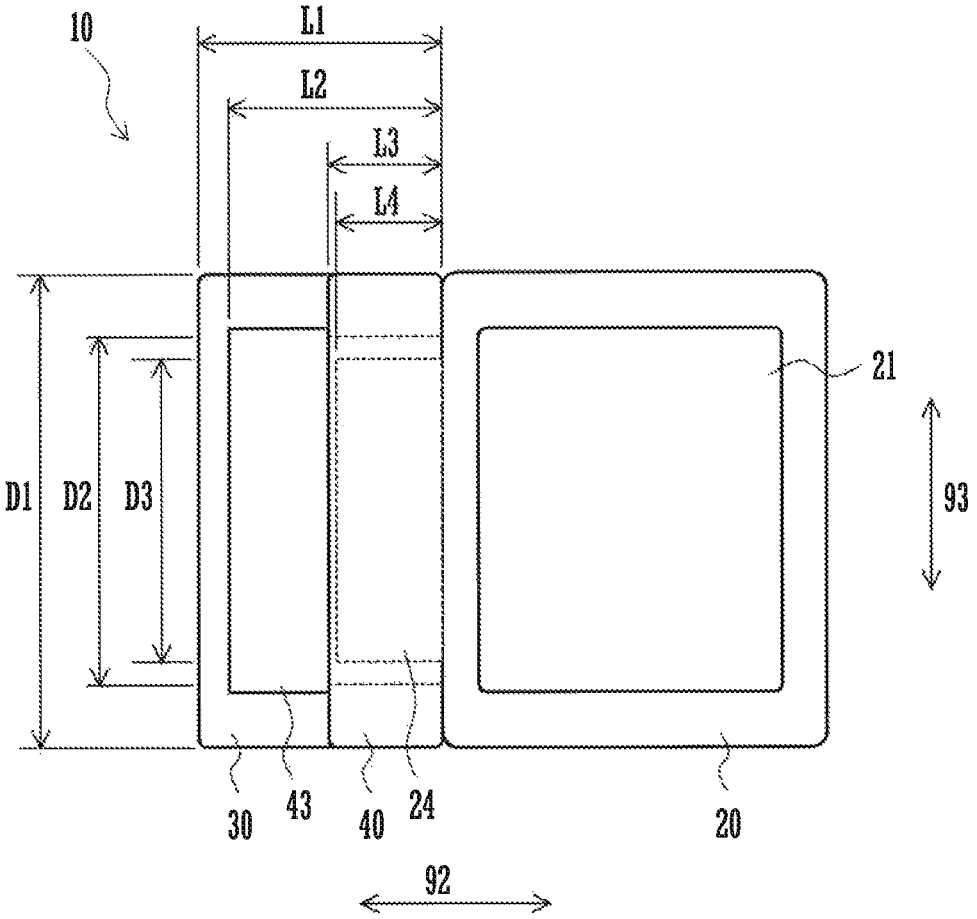
FIG. 4 is a schematic plan view of the image forming apparatus.

As illustrated in FIG. 4, the second processing unit 40 preferably has dimensions that are equal to and less than the dimensions of the first processing unit 30 in both of the toward-away direction 92 and the depth direction 93. In this embodiment, the second processing unit 40 has a dimension L2 that is smaller than a dimension L1 of the first processing unit 30 in the toward-away direction 92, and has a dimension D1 that is the same dimension of the first processing unit 30 in the depth direction 93. Since the second processing unit 40 is not larger than the first processing unit 30 in a plan view, the second processing unit 40 can be stably supported by the first processing unit 30.

Although the second processing unit 40 is slidable in the toward-away direction 92, the second processing unit is disposed so not to protrude outward of the first processing unit 30 in a plan view when the main body 20 is in the operating state. This can further decrease the footprint of the image forming apparatus 10 when the main body 20 is in the operating state.

It is preferable that the second processing unit 40 be lighter in weight than the first processing unit 30. Since the barycentric position of the first processing unit 30 and the second processing unit 40 that are considered as one object is lowered, the second processing unit 40 can be stably supported by the first processing unit 30.

In the toward-away direction 92, the dimension L4 of the manual-feed tray 24 is smaller than the dimension L3 of the second processing unit 40 other than the output tray 43, and in the depth direction 93, the dimension D3 of the manual-feed tray 24 is smaller than the dimension D2 of the hollow 48. The manual-feed tray 24 does not protrude outwardly of the first processing unit 30 in a plan view.

Figure 5:
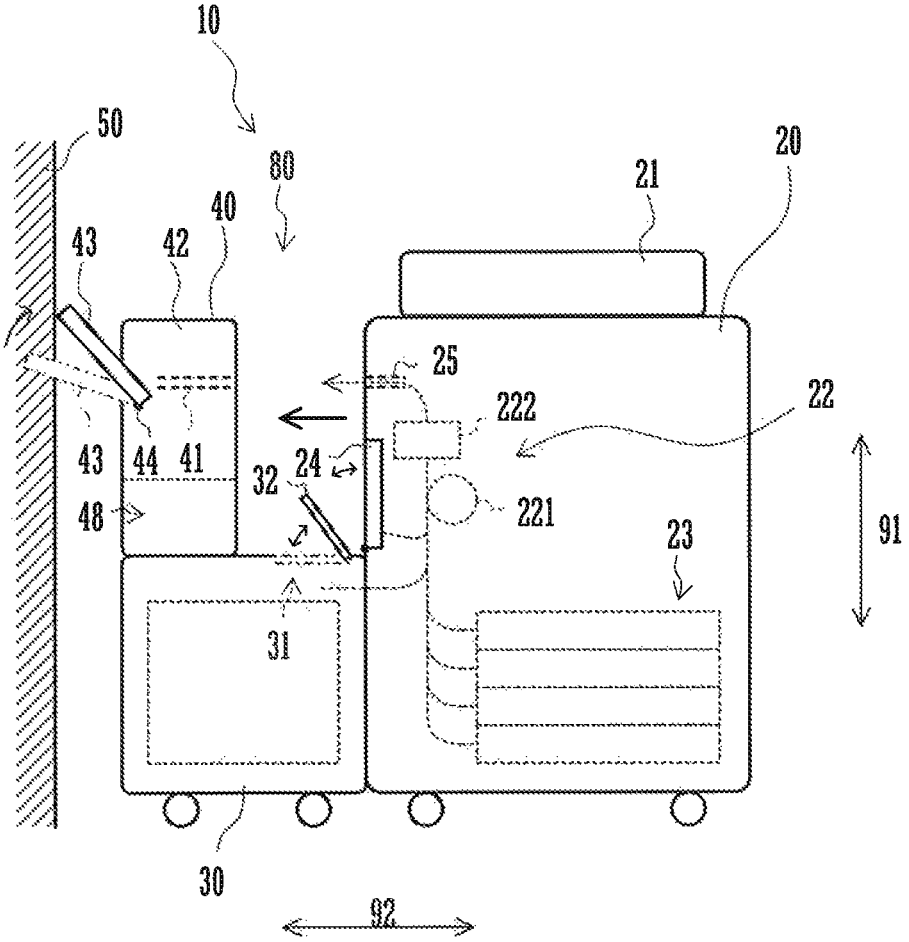
FIG. 5 illustrates the configuration where an output tray and a manual-feed tray are rotatable.

As illustrated in FIG. 5, the second processing unit 40 in Embodiment 1 includes a second processing unit main body 42 and the output tray 43. The output tray 43 is supported at a lateral face of the second processing unit main body 42 on the opposite side of the main body 20 so as to be rotatable in a predetermined range around a shaft member 44 extending in the depth direction 93.

The lower limit position of the rotatable range of the output tray 43 is preferably at a position where the output tray 43 is directed obliquely upward toward the downstream in the direction away from the main body 20, i.e., in the sheet conveyance direction on the output tray 43. The output tray 43 is rotatable upward from the lower limit position. This can avoid breakage of the output tray 43 if the output tray 43 collides with an external object 50 such as wall during movement of the second processing unit 40 in the direction away from the main body 20, because the output tray 43 can rotate upward. When the second processing unit 40 is moved in the direction away from the main body 20, the output tray 43 may not collide with the external object 50, but the footprint of the apparatus can be decreased more because the output tray 43 is rotated upward.

In one example, the upper limit position of the output tray 43 is the position where the downstream end of the output tray 43 in the direction away from the main body 20 is overlapped with the downstream end of the second processing unit main body 42 in a plan view. Since the shaft member 44 is disposed upstream of the downstream end of the second processing unit main body 42, the downstream end of the output tray 43 at the upper limit position is disposed downstream of the shaft member 44 in the direction away from the main body 20. When the second processing unit 40 is moved from the connecting position to the separate position, even if the output tray 43 rotates due to excessive force, the downstream end of the output tray 43 is not closer to the main body 20 than the shaft member 44. That is, when the second processing unit 40 is moved from the separate position to the connecting position, the output tray 43 can rotate from the upper limit position to the lower limit position due to its own weight. In this way, there is no need to perform the operation to rotate the output tray 43, and so the workability can be improved.

Figure 6:
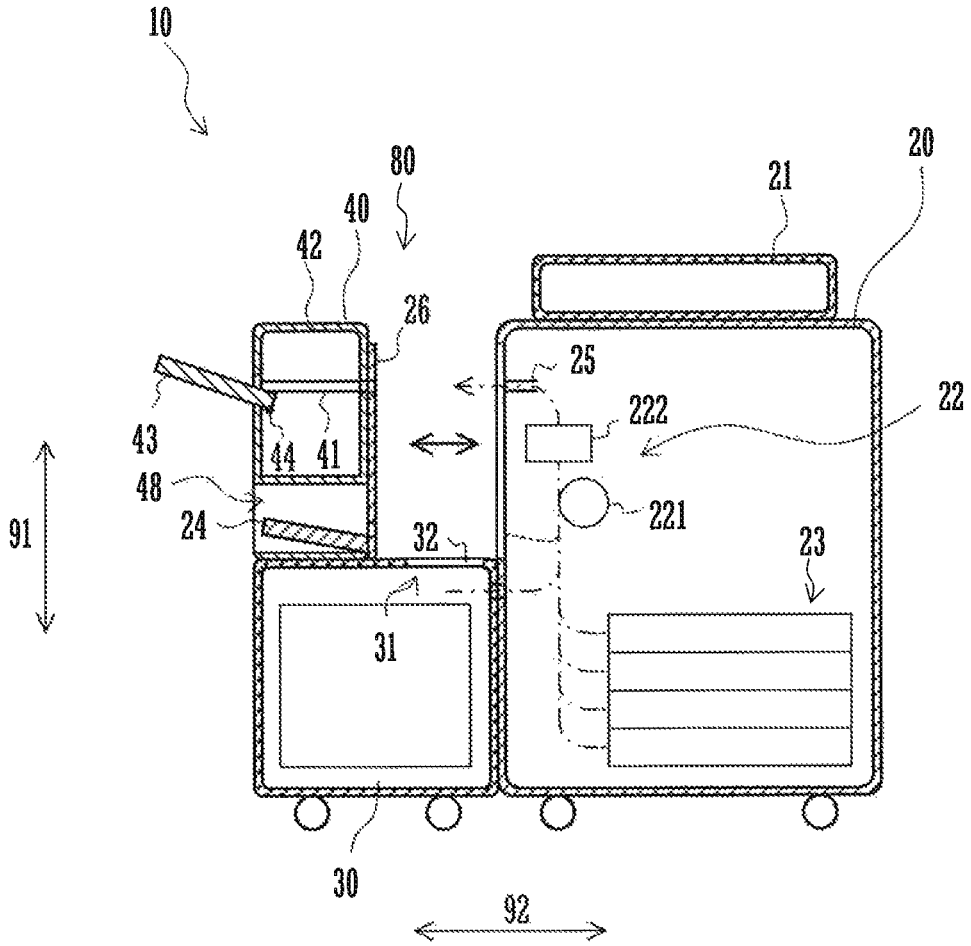
FIG. 6 illustrates the configuration where a side door of the main body is openable/closable.

As illustrated in FIG. 6, the main body 20 has a side door 26 that can be open/close at a lateral face supporting the manual-feed tray 24. In on example, the side door 26 is slidable in the toward-away direction 92. In this embodiment, the sheet conveyance path of the image forming section 22 is provided on a lateral face side where the first processing unit 30, the second processing unit 40 and the manual-feed tray 24 are disposed. This can shorten the length of the overall sheet conveyance path as compared with the case where the sheet conveyance path is provided on a lateral face side opposite of this, and so can suppress a failure in conveyance of a sheet.

Since the main body 20 has the side door 26 on the same lateral face side as that of the first processing unit 30 and the second processing unit 40, the side door 26 is opened when the second processing unit 40 is disposed at the separate position, whereby maintenance of the inside of the main body 20 can be easily performed from the lateral face side of the main body 20. This can facilitate the maintenance of the photoreceptor drum 221, the fixing unit 222, the sheet conveyance path and the like.

A first lock mechanism to lock the side door 26 in the close state to the main body 20 and a second lock mechanism to lock the second processing unit 40 at the connecting position are further provided, where the first lock mechanism and the second lock mechanism may be configured in an interlocking manner.

Specifically, the following configuration example can be considered. A first cylinder that can be displaced vertically is provided at the side door 26, and the first cylinder displaced downward latches with a first recess provided at the main body 20 so that the side door 26 is locked in the close state to the main body 20. On the other hand, the first cylinder displaced upward unlocks the first lock mechanism.

Similarly, a second cylinder that can be displaced vertically is provided at the front face of the second processing unit 40. The second cylinder displaced downward latches with a second recess provided at the front face of the first processing unit 30 so that sliding of the second processing unit 40 is locked. On the other hand, the second cylinder displaced upward unlocks the second lock mechanism.

The first cylinder and the second cylinder are mutually joined, so that vertical movement of one of them means vertical movement of the other in the same direction at the same time.

This allows switching between lock and unlock of the side door 26 and the second processing unit 40 with one operation, and so the workability can be improved.

The side door 26 may be fixed to the second processing unit 40 so that the side door 26 and the manual-feed tray 24 are slid together with the second processing unit 40. This can expose the opening 31 of the first processing unit 30 by moving the second processing unit 40 to the separate position, and the workability can be improved without necessity of rotating the manual-feed tray 24 to the storage position.

The hollow 48 may have openings at a lateral face of the second processing unit 40 on the main body side facing the main body 20 and at least one face other than the lateral face on the main body side, and so have openings at the lateral face of the second processing unit 40 on the main body side and at at least one of the lateral faces of the lateral face on the opposite side of the main body side, the lateral face on the front face side and the lateral face on the rear face side. That is, the hollow 48 may open to two faces, three faces or four faces including the lateral face of the second processing unit 40 on the main body side. The opening of the hollow 48 does not open at the entire area of one lateral face in the width direction, and of course it may open so as to leave the support part to support apart above the hollow 48 of the second processing unit 40.

Figure 9:
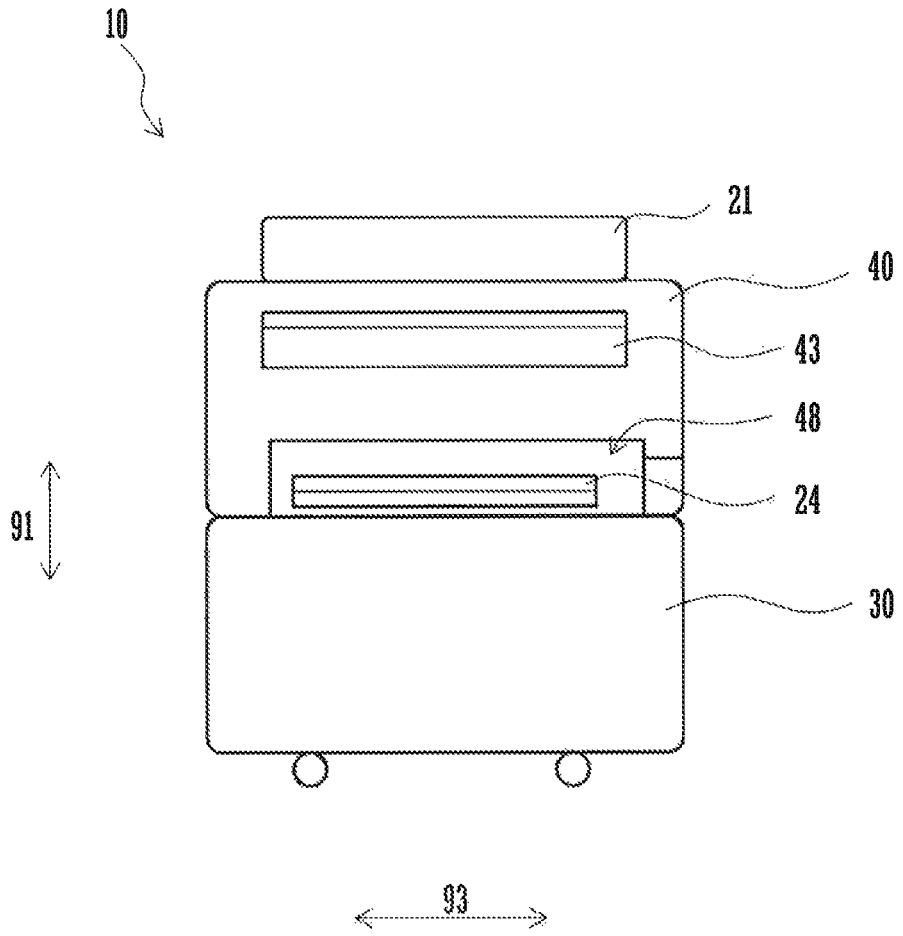
FIG. 9 is a schematic left lateral view of an image forming apparatus according to Embodiment 2.
Figure 10:
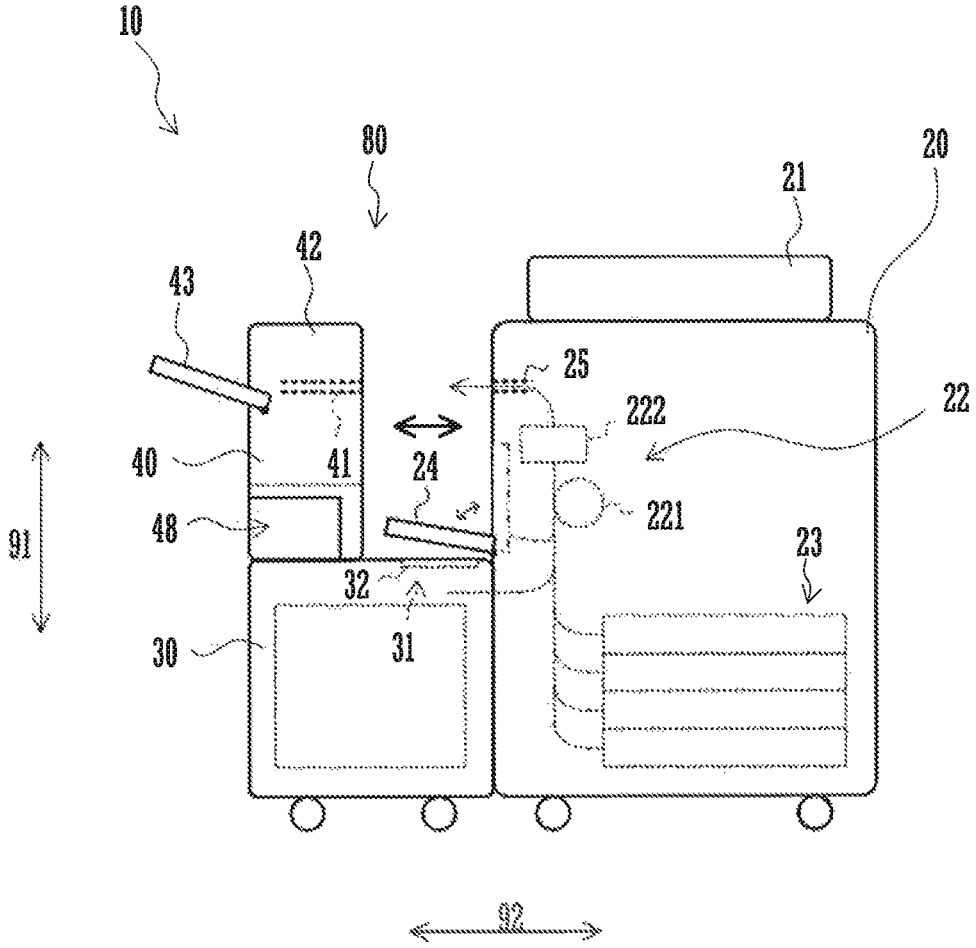
FIG. 10 is a front view illustrative of the schematic configuration of the image forming apparatus according to Embodiment 2.

For instance, as in the image forming apparatus 10 according to Embodiment 2 in FIGS. 9 and 10, the hollow 48 may penetrate through in the toward-away direction 92, and may open to the lateral face of the second processing unit 40 on the front face side as well so as to open at three lateral faces including the lateral face on the main body side, the lateral face on the opposite side of the lateral face on the main body side and the lateral face on the front face side. Such a configuration facilitates the operation such as supplying of a sheet to the manual-feed tray 24 from the front face side when the second processing unit 40 is disposed at the connecting position as well, and so the operability and the working efficiency of the user can be improved.

The hollow 48 may open at the two lateral faces including the lateral face on the main body side and the lateral face on the front face side. In this case as well, the advantageous effect of facilitating the operation such as supplying of a sheet to the manual-feed tray 24 from the front face side can be achieved.

Figure 11:
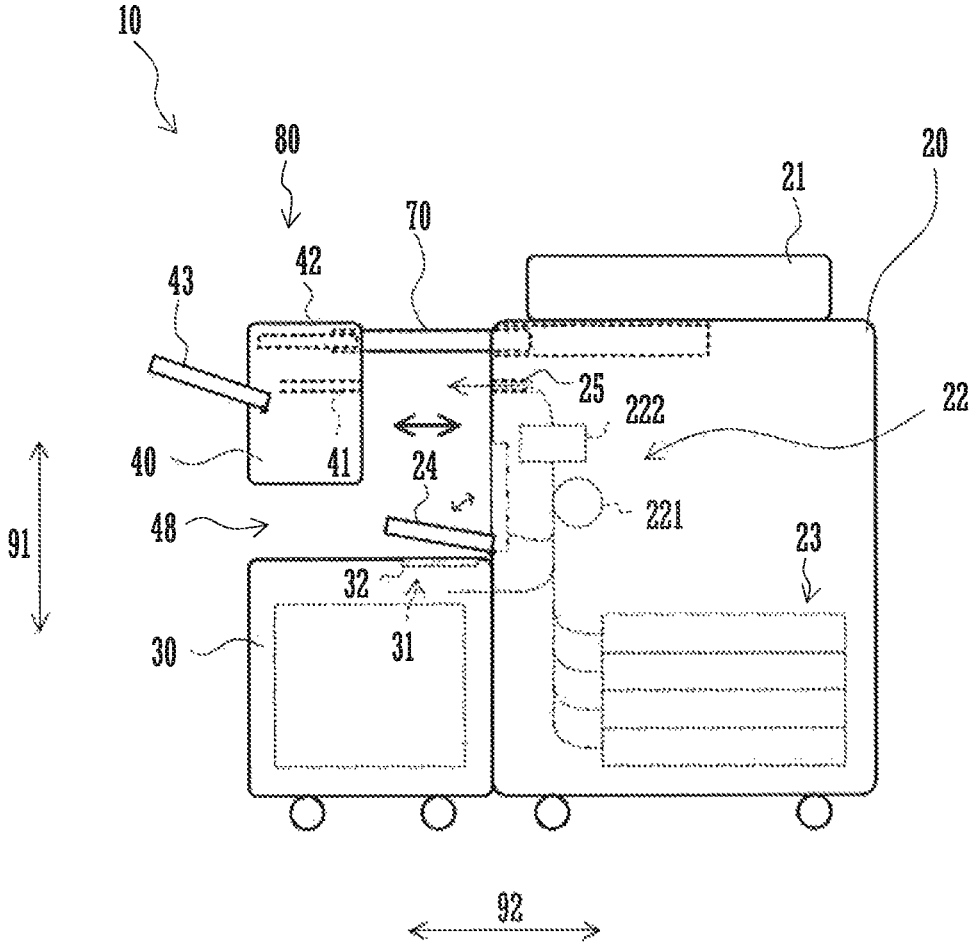
FIG. 11 is a front view illustrative of the schematic configuration of the image forming apparatus according to Embodiment 3.

As in the image forming apparatus 10 according to Embodiment 3 in FIG. 11, the second processing unit 40 and the first processing unit 30 may be disposed so as to be separated in the vertical direction 91. This can makes use of the space between the second processing unit 40 and the first processing unit 30 in the vertical direction 91 effectively. For instance, when at least the second processing unit 40 is disposed at the connecting position, the manual-feed tray 24 is disposed between the second processing unit 40 and the first processing unit 30 in the vertical direction 91, whereby supplying and taking-out of a sheet to/from the manual-feed tray 24 can be easily performed from any direction including the toward-away direction 92 and the depth direction 93, and so the workability can be improved. In the image forming apparatus 10 according to Embodiment 3, the space between the second processing unit 40 and the first processing unit 30 in the vertical direction 91 corresponds to the hollow 48.

In such a disposition of the second processing unit 40 and the first processing unit 30 separated in the vertical direction 91, the second processing unit 40 is movable with respect to the main body 20 in the toward-away direction 92 as follows. As illustrated in FIG. 11, a pair of slide rails 70 that includes an outer rail, a middle rail and an inner rail and is stretchable in two steps is prepared, and the outer rails are provided at the main body 20 and the inner rails are provided at the second processing unit 40. That is, the second processing unit 40 is supported to the main body 20 via the pair of slide rails. Pressing the second processing unit 40 along the toward-away direction 92 makes the slide rails 70 elongate and contract, so that the second processing unit 40 moves with respect to the main body 20 in the toward-away direction 92. A specific example of the slide rails 70 may be accuride rail (trade name). This is not a limited example, and other known techniques may be used.

On the same lateral face of the main body 20 as the first processing unit 30 and the second processing unit 40 provided, an output tray may be provided instead of the manual-feed tray 24. Such a configuration also can lead to the advantageous effect of decreasing the footprint and facilitating maintenance of the first processing unit 30 and the second processing unit 40 provided on the lateral face of the main body 20.

The lid member 32 is not always provided. The opening 31 may be open/close by sliding the second processing unit 40 without the lid member 32. In this configuration, the bottom face of the second processing unit 40 can serve as the lid member.

In both of the toward-away direction 92 and the depth direction 93, a part of the second processing unit 40 other than the output tray 43, i.e., the second processing unit main body 42 may have a dimension L3 that is equal to or less than a dimension L1 of the first processing unit 30. As stated above, although it is preferable that the second processing unit 40 is not larger than the first processing unit 30 in a plan view, since the output tray 43 is relatively lightweight as compared with the first processing unit 30 and the second processing unit main body 42, it may be configured so that the second processing unit main body 42 is not larger than the first processing unit 30 in a plan view, whereby the second processing unit 40 can be stably supported by the first processing unit 30.

Both of the first processing unit 30 and the second processing unit 40 may be sheet-feeding apparatuses or post-processing apparatuses. This can lead to the advantageous effects of decreasing the footprint and facilitating maintenance of the first processing unit 30 and the second processing unit 40. A similar effect can be achieved from the configuration where the first processing unit 30 is a post-processing unit and the second processing unit 40 is a sheet-feeding unit.

The present invention is applicable to an image forming apparatus 10 that is an ink jet type image forming apparatus instead of an electrophotographic type copying machine. The image forming apparatus 10 is not limited to a copying machine especially, and the present invention is applicable to any apparatus that performs image forming processing to a sheet, which may be a printer or a facsimile apparatus.

Technical features of the aforementioned embodiments may be combined with each other, whereby a new embodiment can be configured.

The foregoing embodiments are illustrative in all points and should not be construed to limit the present invention. The scope of the present invention is defined not by the foregoing embodiments but by the following claims. Further, the scope of the present invention is intended to include all modifications within the meanings and scopes of claims and equivalents.

REFERENCE SIGNS LIST

10 Image forming apparatus
20 Main body

24 Manual-feed tray (sheet tray)
26 Side door (door)
30 First processing unit
31 Opening
40 Second processing unit
42 Second processing unit main body
43 Output tray
48 Hollow
91 Vertical direction
92 Toward-away direction
93 Depth direction

The invention claimed is:

1. A processing apparatus including a first processing unit and a second processing unit that are stacked vertically on a side of one lateral face of a main apparatus to perform image forming processing to a sheet, the main apparatus being provided with a sheet tray having a base end part supported at the lateral face, wherein the second processing unit is disposed on the first processing unit, the second processing unit being slidable between a connecting position of connecting to the main apparatus and a predetermined separate position away from the main apparatus in a toward-away direction to move toward or away from the main apparatus, the second processing unit having a space part, in which at least part of the sheet tray can be placed when the second processing unit is at the connecting position, and the space part has openings on a lateral face of the second processing unit that is on a side of the main apparatus facing the main apparatus and on at least one lateral face other than the lateral face on the side of the main apparatus.

2. The processing apparatus according to claim 1, wherein the sheet tray is configured to be rotatable around the based end part as a supporting point between a protruding position that protrudes in a horizontal direction and a storage position along the lateral face of the main apparatus.

3. The processing apparatus according to claim 2, wherein the first processing unit has an opening at a top face thereof, through which a member relating to image forming processing is loaded and unloaded, the opening being exposed when the second processing unit is disposed at the separate position and the sheet tray is disposed at the storage position.

4. The processing apparatus according to claim 1, wherein the space part penetrates through in the toward-away direction.

5. The processing apparatus according to claim 1, wherein the space part has openings at the lateral face of the second processing unit that is on the side of the main apparatus, and at a lateral face on a front face side of the second processing unit.

6. The processing apparatus according to claim 4, wherein the space part penetrates through in the toward-away direction, and the space part further has an opening at a lateral face of the second processing unit on a front face side of the second processing unit.

7. The processing apparatus according to claim 1, wherein the second processing unit is supported at a top face of the first processing unit, and is slidable in the toward-away direction.

8. The processing apparatus according to claim 1, wherein the second processing unit is disposed upward away from the first processing unit, and when the second processing unit is disposed at the connecting position, the sheet tray is disposed between the first processing unit and the second processing unit.

9. An image forming apparatus, comprising:

a main body that performs image forming processing to a sheet, the main body being provided with a sheet tray having a base end part supported at one lateral face of the main body; and a first processing unit and a second processing unit that are stacked vertically on a side of the lateral face of the main body, wherein the second processing unit is disposed on the first processing unit, the second processing unit being slidable between a connecting position of connecting to the main body and a predetermined separate position away from the main body in a toward-away direction to move toward or away from the main body, the second processing unit having a space part, in which at least part of the sheet tray can be placed when the second processing unit is at the connecting position, and the space part has openings at a lateral face of the second processing unit that is on a side of the main body facing the main body and on at least one lateral face other than the lateral face on the side of the main body.

10. The image forming apparatus according to claim 9, wherein the sheet tray is configured to be rotatable around the based end part as a supporting point between a protruding position that protrudes in a horizontal direction and a storage position along the lateral face of the main body.

11. The image forming apparatus according to claim 10, wherein the first processing unit has an opening at a top face thereof, through which a member relating to image forming processing is loaded and unloaded, the opening being exposed when the second processing unit is disposed at the separate position and the sheet tray is disposed at the storage position.

12. The image forming apparatus according to claim 9, wherein the main body has a door capable of being open/closed at the lateral face of the main body.

13. The image forming apparatus according to claim 12, further comprising a first lock mechanism to lock the door in a closed state to the main body and a second lock mechanism to lock the second processing unit at the connecting position, wherein the first lock mechanism and the second lock mechanism are configured in an interlocking manner.

14. The image forming apparatus according to claim 9, wherein the space part penetrates through in the toward-away direction.

15. The image forming apparatus according to claim 9, wherein the space part has openings at the lateral face of the second processing unit that is on a side of the main body, and at a lateral face on a front face side of the second processing unit.

16. The image forming apparatus according to claim 14, wherein the space part penetrates through in the toward-away direction, and the space part further has an opening at a lateral face of the second processing unit on a front face side of the second processing unit.

17. The image forming apparatus according to claim 9, wherein the second processing unit is supported at a top face of the first processing unit, and is slidable in the toward-away direction.

18. The image forming apparatus according to claim 9, wherein the second processing unit is disposed upward away from the first processing unit, and when the second processing unit is disposed at the connecting position, the sheet tray is disposed between the first processing unit and the second processing unit.

* * * * *